US005926173A

United States Patent [19]

Moon

[11] Patent Number: 5,926,173

[45] **Date of Patent: *Jul. 20, 1999**

[54] CIRCUIT FOR DRIVING LIQUID CRYSTAL DISPLAY HAVING POWER SAVING FEATURE

[75] Inventor: Seung-hwan Moon, Seoul, Rep. of Korea

[73] Assignee: Samsung Electronics Co., Ltd., Kyungki-do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/566,255

[22] Filed: Dec. 1, 1995

Related U.S. Application Data

[30] Foreign Application Priority Data

Dec. 1, 1994 [KR] Rep. of Korea ..... 94-32418

[51] Int. Cl.[6] ..... G09G 3/18

[52] U.S. Cl. ..... 345/211; 364/707

[58] Field of Search ..... 345/94, 98, 99, 345/100, 211, 87; 364/707

[56] References Cited

U.S. PATENT DOCUMENTS

| | | | |
|---|---|---|---|
| 5,059,961 | 10/1991 | Cheng | 345/211 |
| 5,248,965 | 9/1993 | Yoshimitsu | 345/211 |
| 5,260,699 | 11/1993 | Lister et al. | 345/97 |
| 5,406,308 | 4/1995 | Shiki | 345/99 |
| 5,485,173 | 1/1996 | Scheffer et al. | 345/87 |
| 5,629,715 | 5/1997 | Zenda | 345/211 |
| 5,699,076 | 12/1997 | Tomiyasu | 345/103 |

FOREIGN PATENT DOCUMENTS

| | | | |
|---|---|---|---|
| 364222 | 4/1990 | European Pat. Off. | 364/707 |
| 0404182 | 12/1990 | European Pat. Off. | 364/707 |
| 58-106622 | 6/1983 | Japan | 345/211 |
| 2105112 | 4/1990 | Japan | 345/211 |

*Primary Examiner*—Lun-Yi Lao
*Attorney, Agent, or Firm*—Pillsbury Madison & Sutro LLP

[57] ABSTRACT

A circuit for driving an LCD panel having a power saving feature, in which each invalid data interval in which there is no data output to be displayed is sensed, and during a time corresponding to each such interval, no power supplied to the LCD panel.

8 Claims, 4 Drawing Sheets

| STV | C_OUT | BLANK(n) |
|---|---|---|
| 0 | 0 | BLANK(n−1) |
| 0 | 1 | 1 |
| 1 | 0 | 0 |
| 1 | 1 | X |

CIRCUIT FOR DRIVING LIQUID CRYSTAL DISPLAY HAVING POWER SAVING FEATURE

BACKGROUND OF THE INVENTION (1) Field of the Invention

The present invention relates to a circuit for driving a liquid crystal display (LCD) having a power saving feature. More specifically, the present invention relates to a circuit for driving an LCD having a power saving feature, in which an invalid data interval showing no data output is sensed, so that no power would be supplied to an LCD panel during the invalid data interval, thereby making it possible to significantly reduce power consumption.

(2) Description of the Prior Art

In accordance with the trend of compactness and lightness in weight of electronic apparatuses, studies and researches are being briskly carried out to obtain a plane (i.e., twin panel) display for replacing the cathode ray tube (CRT).

Of the plane displays, the LCD requires a low voltage and a low driving power, to such a degree that an LSI driver can be used in driving it. Further, an LCD is thin and light in weight, and therefore, many makers have concentrated efforts to put the LCDS to a practical use.

Referring to the attached drawings, a conventional LCD driving circuit will be described.

FIG. 1 is a block diagram showing a conventional LCD driving circuit.

As shown in FIG. 1, the conventional LCD driving circuit includes: a timing section 10 with its input terminals connected to a vertical synchronizing signal line VSYNC, to a horizontal synchronizing signal line HSYNC, and to a data signal line DATA; an LCD power source section 20 with its input terminals connected to a power source voltage VDD, and to an output terminal of the timing section 10; a data driving section 30 with its input terminals connected to the timing section 10 and to an output terminal of the LCD power source section 20; a scanning driving section 40 with its input terminals connected to the timing section 10 and to an output terminal of the LCD power source section 20; and an LCD panel 50 with its input terminals connected to the data driving section 30 and to the scanning driving section 40.

The above described conventional LCD driving circuit operates in the following manner.

The timing section 10, which consists mainly of a gate array, receives external video signals such as vertical synchronizing signals VSYNC, horizontal synchronizing signals and data signals, so as to supply the data signals to the data driving section 30, and so as to supply starting signals STV to the scanning section 40 in a controlled manner at proper timing.

FIG. 2 is a timing chart for the conventional LCD driving circuit.

As shown in FIG. 2, the timing section 10 begins to output data signals DATA together with the starting signals STV after passing of a horizontal synchronizing signal HSYNC from the time of beginning of a vertical synchronizing signal VSYNC. The timing section 10 completes the outputting of the data signals DATA before the generation of a horizontal synchronizing signal HSYNC from the end of a vertical synchronizing signal VSYNC.

The horizontal synchronizing signals HSYNC of 525 H periods correspond to an interval of the vertical synchronizing signals VSYNC of 1V periods. Of the 525 H periods of the horizontal synchronizing signals HSYNC, the valid data intervals of the data signals DATA are 480 H periods. Therefore, 525 H periods of the horizontal synchronizing signals HSYNC less 480 H periods of the valid data intervals equals to 45 H periods, and these 45 H periods correspond to invalid data intervals.

If data signals DATA are supplied from the timing section 10 during the valid data intervals, the data driving section 30 outputs to the LCD panel 50 a gradation voltage corresponding to the data signals, so that the line data selected by the scanning driving section 40 is displayed.

The scanning driving section 40 selects the lines of the LCD panel 50 for each period of the horizontal synchronizing signals HSYNC, so that the data is displayed. This is repeatedly carried out, thereby displaying pictures on the screen.

However, in the above described conventional LCD driving circuit, power is supplied even during the invalid data interval, with the result that a corresponding portion of the power is squandered. That disadvantage is a sensitive problem in a battery-driven portable computer.

SUMMARY OF THE INVENTION

The present invention is intended to overcome the above-described disadvantages of the conventional techniques.

Therefore it is the object of the present invention to provide an LCD driving circuit having a power saving feature, in which power is not supplied during detected invalid data intervals, wherein data signals are not transmitted thereby significantly reducing the power consumption.

In achieving the above object, the LCD driving circuit having a power saving feature according to the present invention, includes:

an LCD power source section for generating voltages to be supplied to an LCD panel in the form of data signals;

a data driving section for providing the voltages of the LCD power source section supplied to a column line of the LCD panel, i.e., to a line selected by the data signals;

a scanning driving section for supplying gate signals to row lines of the LCD panel, so as to provide the voltages of the data driving section supplied to the respective pixels of the LCD panel; and a means for blocking the power of the LCD power source section during periods in which data signals are not actually displayed.

Further, the means for blocking the power of the LCD power source section includes:

a blank sensing section for sensing invalid data intervals in which data signals are not supplied from the starting signals of a timing section, and from carry signals of the scanning driving section; and a power blocking section for withholding power from the LCD power source section during the invalid data intervals in accordance with signals from the blank sensing section.

BRIEF DESCRIPTION OF THE DRAWINGS

The above object and other advantages of the present invention will become more apparent by describing in detail the preferred embodiment of the present invention with reference to the attached drawings, in which.

DESCRIPTION OF THE PREFERRED EMBODIMENT

The preferred embodiment of the present invention will be described in detail referring to the attached drawings, so that those ordinarily skilled in the art will be able to easily understand it.

Figure 3:
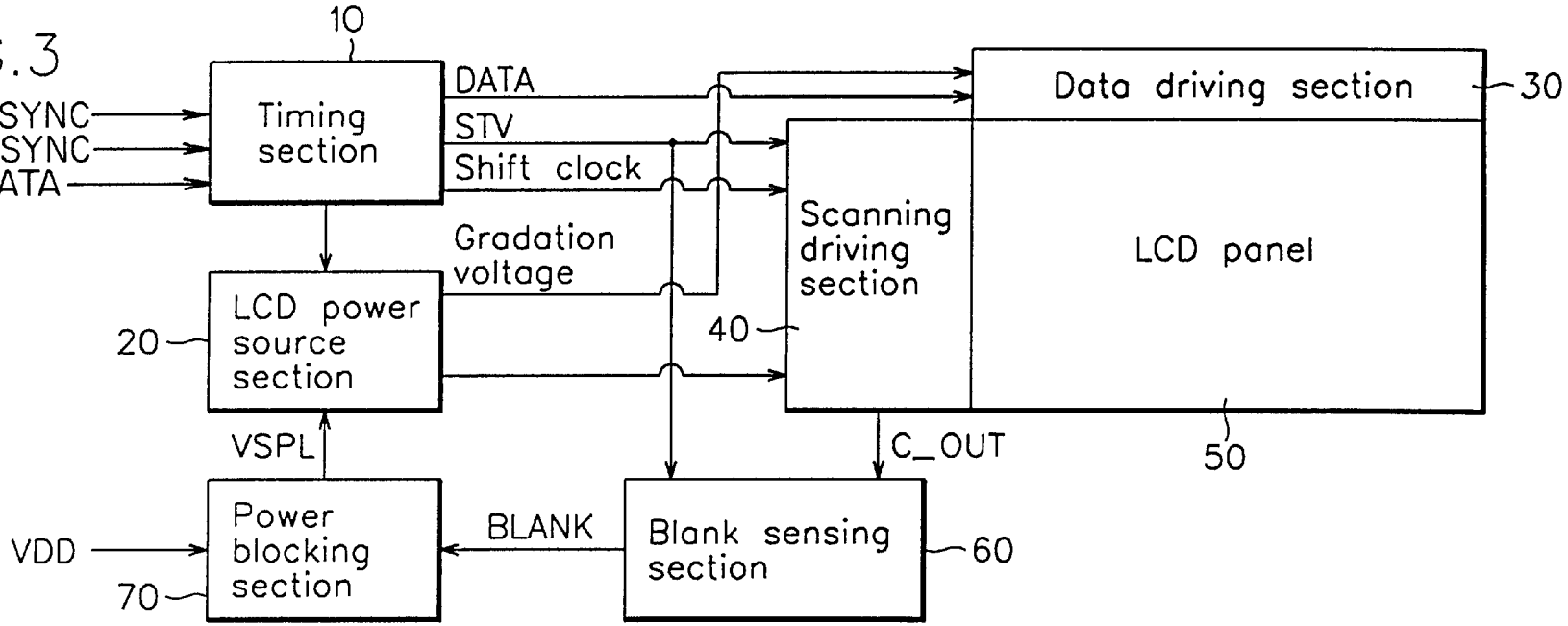
FIG. 3 is a block diagram showing the structure of an LCD driving circuit having a power saving feature according to the present invention.

FIG. 3 is a block diagram showing the structure of an LCD driving circuit having a power saving feature according to the present invention.

As illustrated in FIG. 3, the LCD driving circuit having a power saving feature according to the present invention, includes: a timing section 10 with its input terminals connected to a vertical synchronizing signal line VSYNC, to a horizontal synchronizing signal line HSYNC, and to a data signal line DATA; an LCD power source section 20 with its input terminal connected to an output terminal of the timing section 10; a data driving section 30 with its input terminals connected to an output terminal of the timing section 10 and to an output terminal of the LCD power source section 20; a scanning driving section with its input terminals connected to an output terminal of the timing section 10 and to an output terminal of the LCD power source section 20; an LCD panel 50 with its input terminals connected to an output terminal of the data driving section 30 and to an output terminal of the scanning driving section 40; a blank sensing section 60 with its input terminals connected to an output terminal of the timing section 10 and to an output terminal of the scanning driving section 40; and a power blocking section 70 with its input terminals connected to a power source voltage VDD and to an output terminal of the blank sensing section 60, and with its output terminal connected to the LCD power source section 20.

Figure 1:
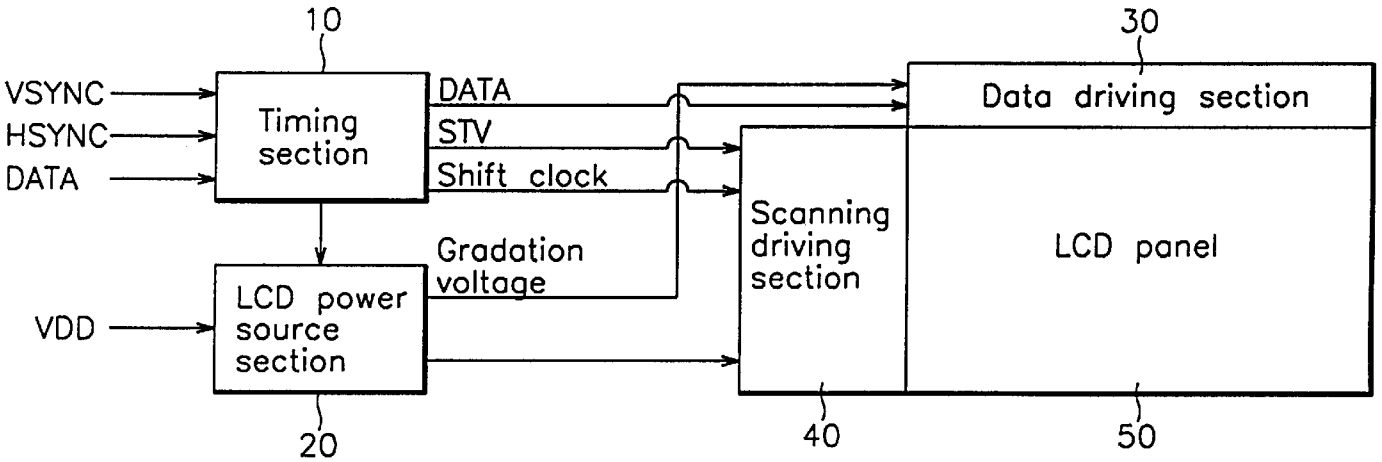
FIG. 1 (PRIOR ART)
FIG. 1 is a block diagram showing the structure of a conventional LCD driving circuit.
Figure 2:
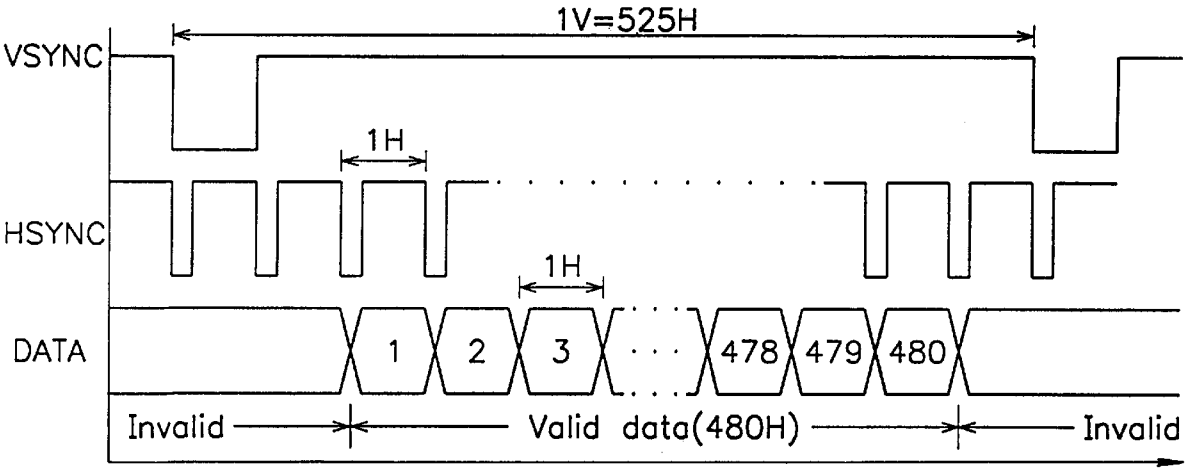
FIG. 2 (PRIOR ART)
FIG. 2 is a timing chart for the conventional LCD FIG. 1.

In the description of the preferred embodiment of the present invention, the elements which perform the same functions and roles as those of FIG. 1 are referred to herein using the same reference characters.

Figure 5:
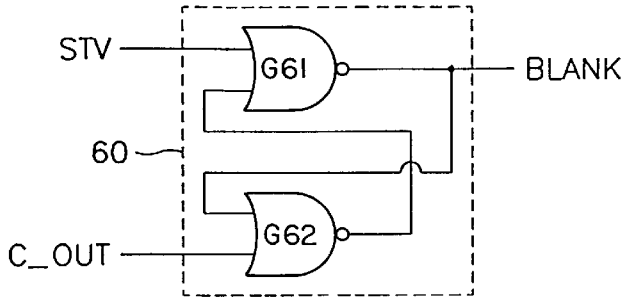
FIG. 5 illustrates the circuit of the blank sensing section of the LCD driving circuit having a power saving feature according to the present invention.

FIG. 5 illustrates the circuit of the blank sensing section of the LCD driving circuit having a power saving feature according to the present invention.

As shown in FIG. 5, the blank sensing section 60 of the LCD driving circuit having a power saving feature according to the present invention includes: a first NOR gate G61 with one input terminal connected to the starting signal line STV of the timing section 10, and with another input terminal connected to the output terminal of a second NOR gate G62; and the second NOR gate G62 with one of its input terminals connected to an output terminal of the first NOR gate G61, and with its other input terminal connected to an output terminal C-OUT of the scanning driving section 60.

Figure 6:
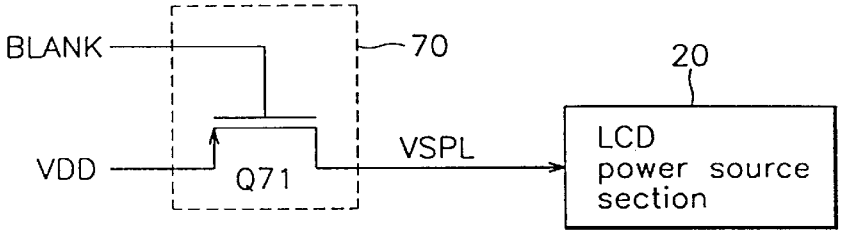
FIG. 6 illustrates the circuit of the power blocking section of the LCD driving circuit having a power saving feature according to the present invention.

FIG. 6 illustrates the circuit of the power blocking section 70 of the LCD driving circuit having a power saving feature according to the present invention.

As shown in FIG. 6, the power blocking section 70 of the LCD driving circuit having a power saving feature according to the present invention includes: a transistor Q71 with its gate terminal connected to a blank signal line BLANK of the blank sensing section 60, with its drain terminal connected to a power source voltage VDD, and with its source terminal connected to the LCD power source section.

In the preferred embodiment of the present invention, the power blocking section 70 consists of the transistor Q71. However, the technical scope of the present invention is not limited to this, but can also use a generally known switching device or switching circuit.

Now, the LCD driving circuit having a power saving feature according to the present invention will be described as to its operations.

The timing section 10 receives vertical synchronizing signals VSYNC, horizontal synchronizing signals HSYNC and data signals DATA. The data driving section 30 outputs data signals DATA, while the scanning driving section 40 and the blank sensing section 60 output starting signals STV in a controlled manner, with a proper timing.

Figure 4:
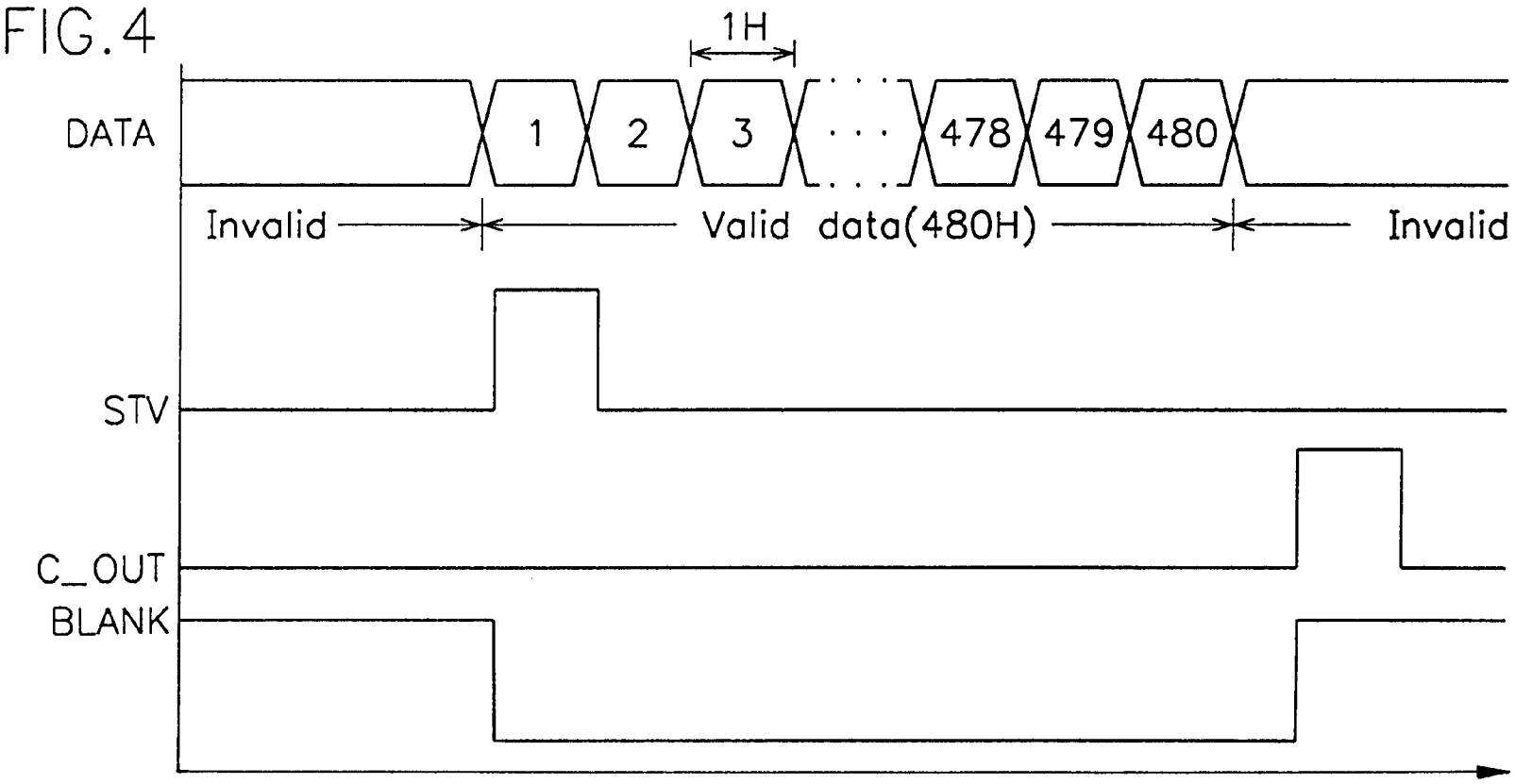
FIG. 4 is a timing chart for the novel LCD driving circuit of FIG. 3.

As shown in FIG. 4, the timing section 10 outputs data signals DATA together with the starting signals STV. Upon completion of the outputting of the data signals DATA, the scanning driving section 40 generates a carry signal C-OUT to the blank sensing section 60.

As described above, the horizontal synchronizing signals HSYNC of 525 H periods correspond to an interval of the vertical synchronizing signals VSYNC of 1V periods. Of the 525 H periods of the horizontal synchronizing signals HSYNC, the valid data intervals of the data signals DATA are the 480 H periods. Therefore, the 525 H periods of the horizontal synchronizing signals HSYNC, less the 480 H periods of the valid data intervals, equals to 45 H periods, and these 45 H periods correspond to invalid data intervals.

When the data signals DATA are supplied from the timing section 10 during the valid data intervals, the data driving section 30 outputs the data signals to the LCD panel 50, so that the data is displayed on the lines selected by the scanning driving section 40.

The scanning driving section 40 selects the lines of the LCD panel 50 at each period of the horizontal synchronizing signals HSYNC, so that the data are displayed. Then this is repeatedly carried out, so that pictures would be displayed on the screen of the LCD panel 50.

During the initial invalid data interval of the vertical synchronizing signals VSYNC in which the starting signal STV has not been supplied from the timing section 10, the blank sensing section 60 receives a low starting signal STV and a carry signal C-OUT. In this case, as shown in FIG. 5, the blank sensing section 60 outputs blank signals BLANK of the previous state (high state) to the power blocking section 70.

When the high blank signals BLANK are inputted from the blank sensing section 60, the transistor Q71 of the power blocking section 70 is turned off, so that the supply of the power source voltage VDD to the LCD power source section 20 is blocked, thereby making it possible to reduce power consumption.

During the valid data interval immediately after the inputting of the starting signal STV from the timing section 10, the blank sensing section 60 receives a high starting signal STV and a low carry signal C-OUT. In this case, as shown in FIG. 5, the blank sensing section 60 outputs a low blank signal BLANK to the power blocking section 70.

Figure 7:
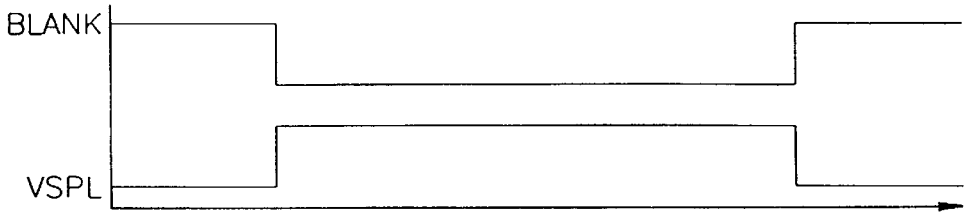
FIG. 7 is a timing chart for the power blocking section of FIG. 6.

When a low blank signal BLANK is inputted from the blank sensing section 60, the transistor Q71 of the power blocking section 70 is turned on, so that the power source voltage VDD is supplied to the LCD power source section 20. Consequently, power is supplied to the data driving section 30, the scanning driving section 40 and the LCD panel 50. For this situation, the voltage wave pattern of the power blocking section 70 is illustrated in FIG. 7.

During the valid data intervals after the inputting of the starting signal STV from the timing section 10, the blank sensing section 60 receives a low starting signal STV and a carry signal C-OUT. In this case, as shown in FIG. 5, the blank sensing section 60 outputs a blank signal BLANK of the previous state (low state) to the power blocking section 70.

Therefore, the power source voltage VDD is supplied continuously to the LCD power source section 20, so that the power is supplied to the data driving section 30, the scanning driving section 40 and the LCD panel 50. For this situation, the voltage wave pattern of the power blocking section 70 is illustrated in FIG. 7.

During the invalid data interval immediately after the inputting of the carry signal C-OUT from the timing section 10 to the blank sensing section 60, indicating termination of the outputting of data signals DATA, the blank sensing section 60 receives a low starting signal STV and a high carry signal C-OUT. In this case, as shown in FIG. 5, the blank sensing section 60 outputs a high blank signal BLANK to the power blocking section 70.

When a high blank signal BLANK is inputted from the blank sensing section 60, the transistor Q71 of the power blocking section 70 is turned off, so that the supply of the power source voltage VDD to the LCD power source section 20 is blocked, thereby making it possible to save power. For this situation, the voltage wave pattern of the power blocking section 70 is illustrated in FIG. 7.

During the last invalid data interval of the vertical synchronizing signal VSYNC in which the starting signal STV is not inputted from the timing section 10, the blank sensing section 60 receives a low starting signal STV and a carry signal C-OUT. In this case, as shown in FIG. 5, the blank sensing section 60 outputs a blank signal BLANK of the previous state (high state) to the power blocking section 70.

Accordingly, the power source voltage VDD which has been supplied to the LCD power source section 20 is continuously blocked, thereby making it possible to save power consumption. For this situation, the voltage wave pattern of the power blocking section 70 is illustrated in FIG. 7.

In the present invention, the carry signal C-OUT which is the output signal of the scanning driving section 40 is used, but the technical feature of the present invention is not limited to this. Alternatively, an outer counter circuit can be formed, so that a carry signal C-OUT can be generated in 480 H after the inputting of the starting signal STV.

According to the present invention as described above, invalid data intervals in which data signals are not outputted are detected, and the power is withheld from the LCD panel during the invalid data intervals, so that an LCD driving circuit having a power saving feature can be realized. This effect of the present invention can be utilized in the portable information processing field.

What is claimed is:

1. An LCD driving circuit having a power saving feature, comprising:

an LCD power source section for generating voltages supplied to an LCD panel having a plurality of pixel-defining column lines and row lines arranged in columns and rows;

a timing section which receives a vertical synchronizing signal having the same period as a frame period and which outputs a starting signal and a data signal having a valid interval and an invalid interval in one frame period, wherein the valid interval starts in synchronization with the starting signal;

a data driving section for supplying the data signal from said timing section to respective column lines of said LCD panel;

a scanning driving section for supplying a gate signal to the row lines of said LCD panel sequentially from first to last ones of said row lines during the valid interval so as to supply the data signal from said data driving section to respective pixels of said LCD panel, wherein said scanning driving section starts to supply the gate signal in synchronization with the starting signal and generates a carry signal after supplying the gate signal to the last row line to commence the invalid interval; and means responsive to the starting signal and the carry signal for blocking power from being supplied by said LCD power section to said LCD panel during the invalid interval.

2. The LCD driving circuit as claimed in claim 1, further comprising an LCD panel for displaying pictures in accordance with signals supplied from said data driving section and said scanning driving section.

3. The LCD driving circuit as claimed in claim 1, wherein said scanning driving section is arranged for outputting the carry signal after a number of data signals.

4. The LCD driving circuit as claimed in claim 1, further comprising a counter circuit for outputting a carry signal after elapsing of a valid data interval and after inputting of a starting signal.

5. The LCD driving circuit as claimed in any one of claims 3 and 4, wherein said means for blocking the power of said LCD power source section comprises:

a blank sensing section for sensing the invalid interval using the starting signal and the carry signal; and a power blocking section for withholding the power from said LCD power source section during the invalid interval in accordance with signals from said blank sensing section.

6. The LCD driving circuit as claimed in claim 1, wherein said blank sensing section comprises:

a first NOR gate with one input terminal connected to a starting signal line of said timing section; and a second NOR gate with one input terminal connected to an output terminal of said first NOR gate, and another input terminal connected to a carry signal line of said scanning driving section, and with an output terminal connected to another input terminal of said first NOR gate.

7. The LCD driving circuit as claimed in claim 1, wherein said power blocking means includes a control terminal connected to receive blank signals of a blank sensing section, and includes a switching device for supplying or blocking power source voltages in accordance with the blank signals.

8. The LCD driving circuit as claimed in claim 7, wherein said switching device consists of a transistor.

* * * * *